US006579109B2

(12) United States Patent
Yu

(10) Patent No.: US 6,579,109 B2
(45) Date of Patent: Jun. 17, 2003

(54) ELECTRICAL CONNECTOR HAVING ASSOCIATED CARD-EJECTING MEANS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,323

(22) Filed: Mar. 22, 2002

(65) Prior Publication Data

US 2002/0137379 A1 Sep. 26, 2002

(30) Foreign Application Priority Data

Mar. 23, 2001 (TW) ..... 90204411 U

(51) Int. Cl.[7] ..... H01R 13/62
(52) U.S. Cl. ..... 439/159; 439/157
(58) Field of Search ..... 439/159, 152–158, 439/160

(56) References Cited

U.S. PATENT DOCUMENTS 4,952,161 A * 8/1990 Komatsu ..... 439/155
5,536,180 A * 7/1996 Ishida et al. ..... 439/159
5,871,365 A * 2/1999 Kajiura ..... 439/159
5,989,045 A * 11/1999 Kimura ..... 439/159

* cited by examiner

*Primary Examiner*—Hien Vu
(74) *Attorney, Agent, or Firm*—Wei Te Chung

(57) ABSTRACT

An electrical connector (1) comprises a base (10), an insulating housing (21) assembled to the base, a plurality of terminals (22) secured to the housing and a guiding device (40) arranged on each of two sides of the base. The base defines a groove comprising a plurality of sections connected end by end and having different depths. The housing has a mating surface (210) and a soldering surface (211) opposite to the mating surface. A sliding member (26) is assembled to a bottom surface of the housing. The sliding member has a tip 262 extending downwardly into the groove 12. The tip is moveable along the sections of the groove in sequence. Each terminal has a mating portion (220) extending beyond the mating surface of the housing and a solder portion (221) extending beyond the soldering surface of the housing. The guiding device comprises an orbital guiding portion (45), a stopper (48) and a resilient member (30). The housing is located between the stopper and the resilient member.

3 Claims, 5 Drawing Sheets

ELECTRICAL CONNECTOR HAVING ASSOCIATED CARD-EJECTING MEANS

BACKGROUND OF THE INVENTION

1. Field of the Invention

The present invention relates to an electrical connector having associated card-ejecting means for withdrawing an inserted electronic card from the connector.

2. Description of Related Art

Taiwan Patent Application Nos. 83205851, 83111731 and 85107204 each disclose an electrical connector having an ejector for withdrawing an electronic card from the connector. Each ejector commonly needs a push bar to drive a lever to withdraw the card from the connector. However, either operated by hand or automatically, a common disadvantage of above-mentioned connectors is that each of them needs an ejector having a portion exposed out of the connector. A second disadvantage is that each of the said connectors has a complicated structure which increases the manufacturing and assembling costs.

SUMMARY OF THE INVENTION

Accordingly, a first object of the present invention is to provide an electrical connector from which an electronic card can be ejected by hand.

A second object of the present invention is to provide an electrical connector which has a relatively simple structure thereby decreasing manufacturing and assembling costs.

In order to achieve the objects set forth, an electrical connector of the present invention comprises a rectangular base, an insulating housing assembled to the base, a plurality of terminals assembled within the housing and a guiding device arranged beside each of two sides of the base. The base defines a groove comprising a plurality of portions connected end by end and having different depths. The housing has a mating surface, a soldering surface opposite to the mating surface, and a bottom surface connected with the mating surface and the soldering surface. A sliding member is assembled to the bottom surface of the housing and is slidable along a receiving slot of the housing. Each terminal has a mating portion extending beyond the mating surface of the housing, and a solder portion extending beyond the soldering surface of the housing. Each guiding device comprises an orbital guiding portion, a stopper formed in the guiding portion and a resilient part assembled to the guiding portion. The housing has a part coupled between the stopper and the resilient part and abutting against the resilient part.

Other objects, advantages and novel features of the invention will become more apparent from the following detailed description of the preferred embodiment when taken in conjunction with the accompanying drawings.

DETAILED DESCRIPTION OF THE INVENTION

Figure 1:
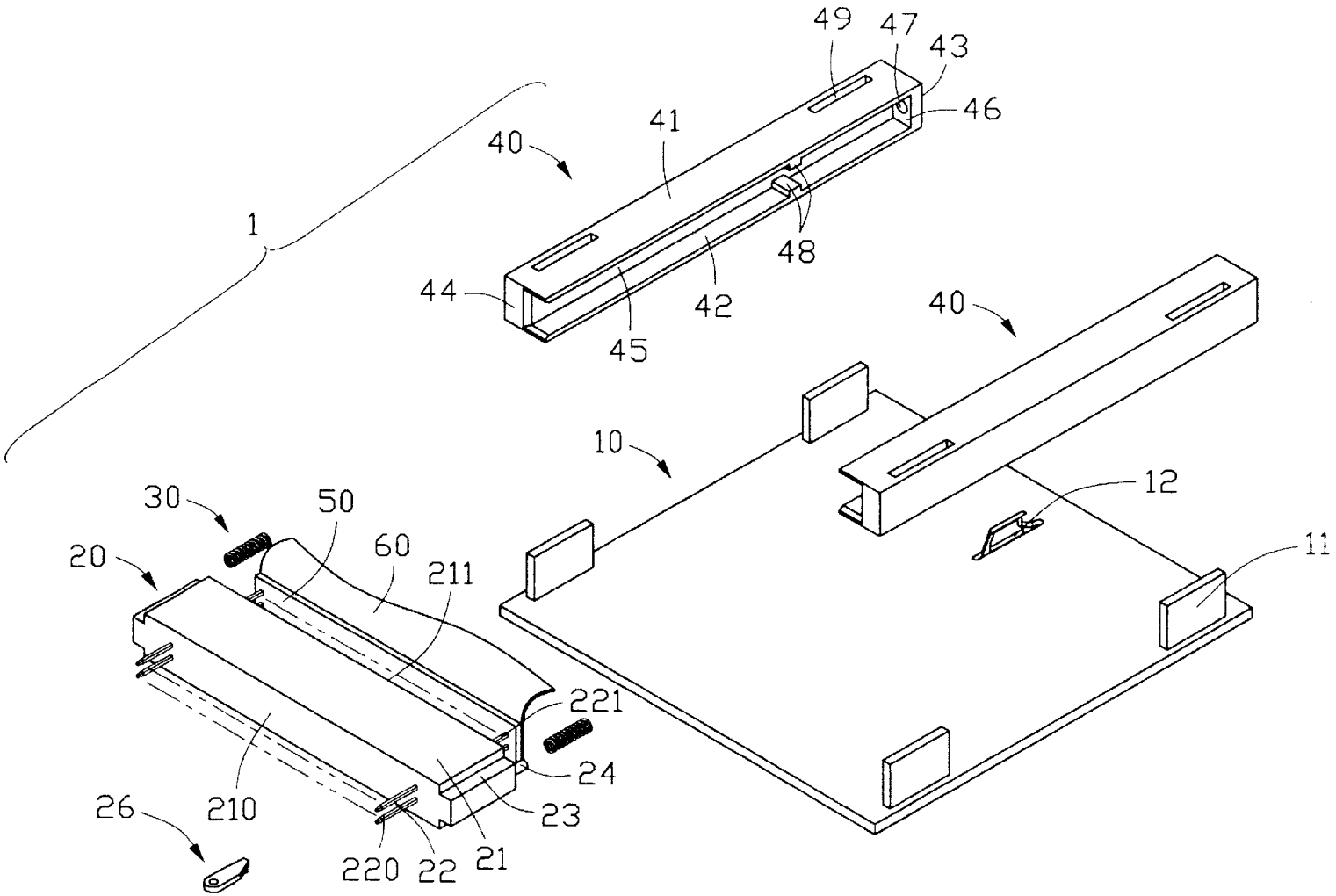
FIG. 1 is an exploded view of an electrical connector of the present invention.

Reference will now be made to the drawing figures to describe the present invention in detail.

Figure 2:
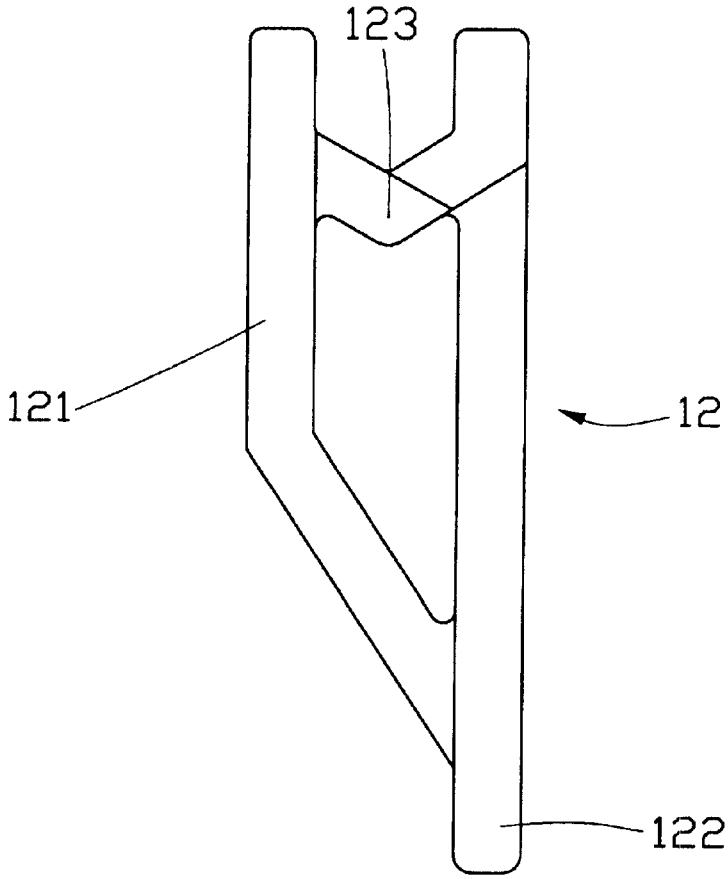
FIG. 2 is a plane view of a heart-shaped groove of the electrical connector of FIG. 1.
Figure 3:
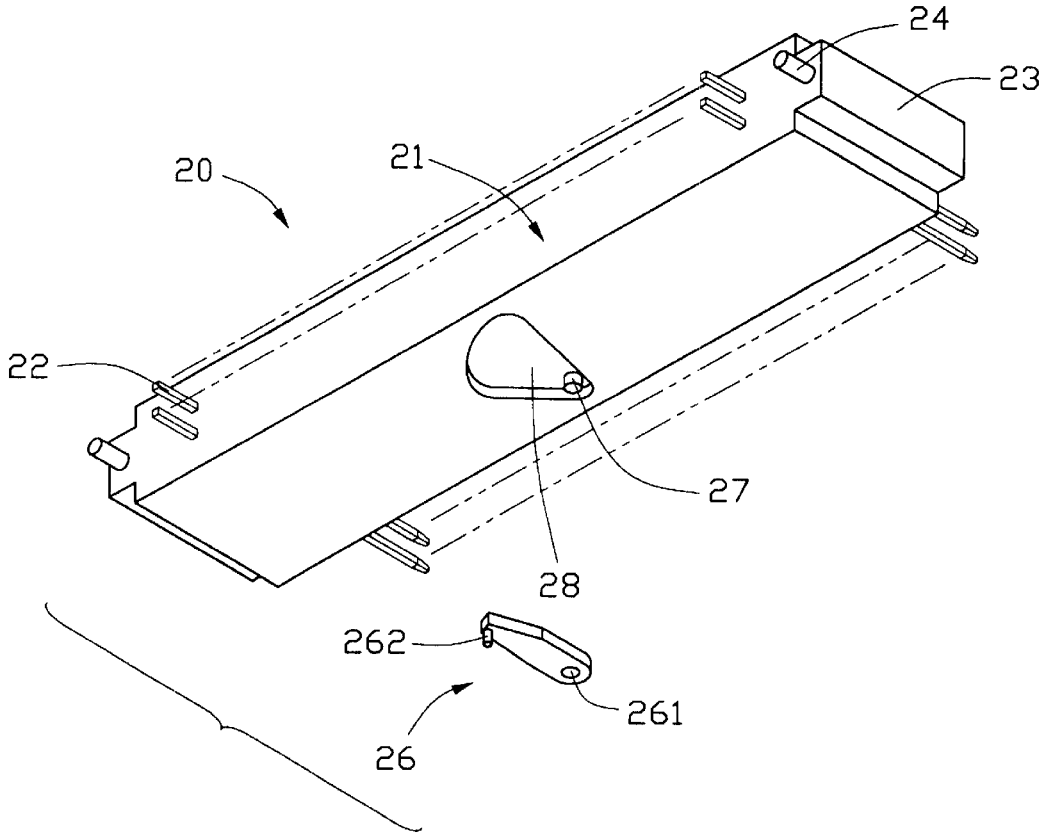
FIG. 3 is a respective view of a header of the electrical connector of FIG. 1.

Referring to FIGS. 1 to 3, an electrical connector 1 of the present invention comprises a rectangular base 10, a header 20, a pair of springs 30, a pair of first guiding devices 40 and a second guiding device (detailed later). The base 10 forms four insert plates 11 at four corners of a top surface of the base 10. The base 10 further defines a heart-shaped groove 12 in a middle thereof. The groove 12 has a first section 122, a second section 123, and a third section 121. The sections 122, 123, 121 are connected end by end in turn and have different depths.

Each of the first guiding devices 40 comprises a top wall 41, a bottom wall 42, a rear wall 43, a side wall 44 and an orbital guiding portion 45 enclosed by above-mentioned walls. The guiding portion 45 defines a recess 47 in a rear surface 46 thereof for retaining an end of the spring 30, and two stoppers 48 spaced from the rear surface 46 thereof. The two stoppers 48 respectively extend from the top wall 41 and the bottom wall 42 toward the guiding portion 45. Each guiding device 40 further defines a pair of through holes 49 through the side wall 44 for retaining to a corresponding insert plate 11 of the base 10.

The header 20 comprises an insulating housing 21 and a plurality of terminals 22 retained to the housing 21 Each terminal 22 comprises a mating portion 220 extending beyond a mating surface 210 of the housing 21, and a solder portion 221 extending beyond a soldering surface 211 of the housing 21. The mating portions 220 of the terminals 22 each have a needle configuration. The solder portions 221 are secured to a transmitting board 50 by through-hole soldering process. The board 50 electrically connects with an end of a flexible printed circuit (FPC) 60. The FPC 60 has another end connecting with other electrical components (not shown), thereby establishing electrical connection between the connector 1 and the other electrical components. In addition, the housing 21 forms a guiding block 23 at each of two opposite sides thereof for insertion into a corresponding guiding portion 45. The housing 21 further forms a protruding post 24 from the mating surface 211 and near the guiding blocks 23 for insertion into the other end of the spring 30. A receiving slot 28 is defined at a middle of the bottom surface of the housing 21. The hosing 21 also forms a positioning post 27 protruding into the receiving slot 28.

The second guiding device constitutes of the positioning post 27, the heart-shaped groove 12 and a sliding member 26. The sliding member 26 defines a hole 261 at one end through a top and a bottom surface thereof. The hole 261 has an inner diameter which is slightly larger than an outer diameter of the positioning post 28. The sliding member 26 also forms a protruding tip 262 at the bottom surface thereof for sliding in the heart-shaped groove 12 of the base 10, thereby withdrawing the card from the connector 1. The tip 262 is located at an end of the sliding member 26 opposite the hole 261.

Figure 4:
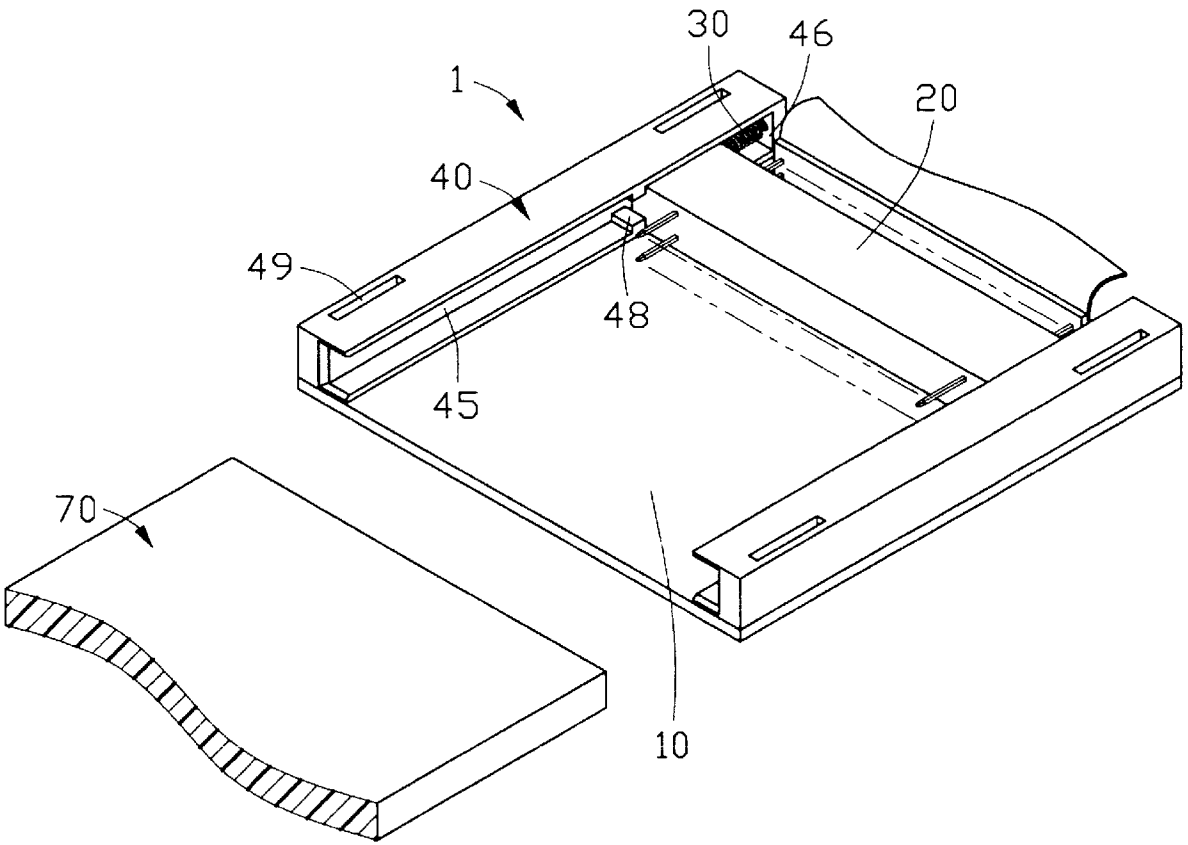
FIG. 4 is an assembled view of the electrical connector of FIG. 1.

Referring to FIG. 4, in assembly, the pair of first guiding devices 40 are secured to two opposite sides of the base 12, wherein the through holes 49 mate with the insert plates 11 of the base 10, and the guiding blocks 23 of the header 20 are secured within the guiding portions 45 and aptly coupled between the rear surface 46 and the stoppers 48. One end of each of the springs 30 is inserted into a corresponding one of the recesses 47 of the first guiding device 40. The other end of each of the springs 30 abuts against the block 23 of the header 20. The protruding posts 24 of the header 20 are inserted into the other ends of the springs 30 thereby preventing the sliding member 26 from disengaging with the springs 30. The positioning post 27 of the receiving slot 28 extends into the hole 261 of the sliding member 26 so that the sliding member 26 can rotate about the positioning post 27. The protruding tip 262 of the sliding member 26 extends downwardly through the receiving slot 28 into a front end of the first section 122 of the heart-shaped groove 12 distant from the second section 123.

Figure 5A:
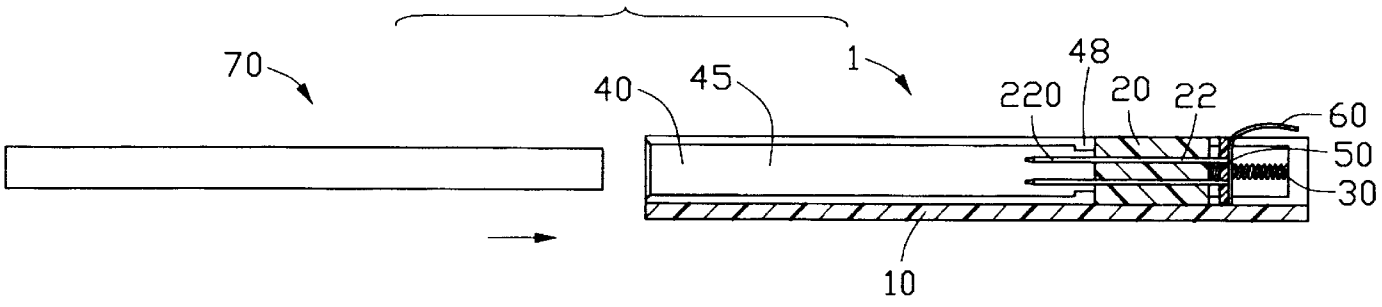
FIGS. 5A to 5C are cross-sectional views of the assembled electrical connector showing a continuous process of the electronic card from inserting into to withdrawing from the connector.
Figure 5B:
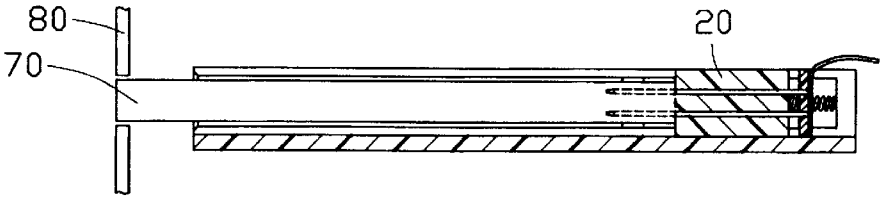
Figure 5C:
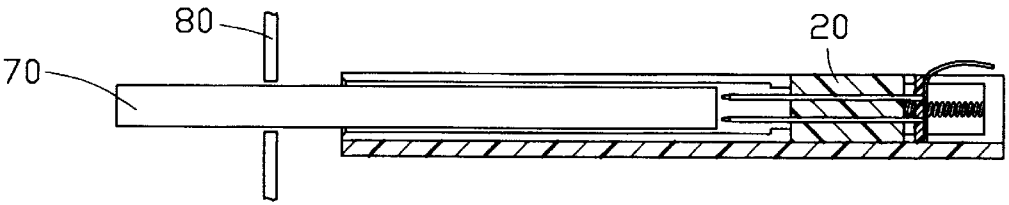

Referring to FIGS. 5A to 5C, when an electronic card 70 is to be inserted into the connector 1, receiving holes (not shown) defined in the card 70 align with the mating portions 220 of the terminals 22 (FIG. 5A). After the card 70 is fully inserted into the connector 1 (FIG. 5B) so that mating portions 220 of the terminals 22 are received in the receiving holes and electrically connect with the card 70, the springs 30 are compressed and the tip 262 of the sliding member 26 is moved from the front end of the first section 122 into the second section 123 of the groove 12 and engages with the base 12 by a pushing force of the springs 30. The second section 123 is deeper than the first section 122. A front end of the card 70 opposite the end in which the receiving holes are defined is located in a shell 80 of an electronic apparatus incorporating the card connector 1. The card 70 does not have any portion protruding out of the shell 80. To eject the card 70 from the connector 1, a user pushes the front end of the card to release the engagement between the tip 262 and the base 10 and causes the tip 262 to enter a rear end of the third section 121 of the groove 12, which is deeper than the second section 123. Release of the pushing force results in that the compressed springs 30 expand to eject the card 70 from the connector 1 as shown in FIG. 5C in which the tip 262 moves from the rear end of the third section 121 to return to the front end of the first section 122. The third section 12 has a gradually decreased depth from its rear end to its front end so that the tip 262 can smoothly move to return to the front end of the first section 122.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having an associated card-ejecting means, the connector comprising:

a base defining insert plates extending upwardly therefrom and a groove at a top surface thereof, wherein the groove comprising first, second and third sections connected end by end and having different depths;

a header comprising an insulating housing and a plurality of terminals retained to the housing, the housing being assembled on the base arid comprising a mating surface and a soldering surface opposite to the mating surface, the terminals being assembled within the housing and each comprising a mating portion extending beyond the mating surface of the housing and a solder portion extending beyond the soldering surface of the housing;

a pair of guiding devices, assembled at each of two opposite sides of the housing, each guiding device comprising a top wall, a bottom wall, a rear wall, a side wall, a guiding portion, a stopper formed in the guiding portion and a resilient member assembled to the guiding portion, the housing being arranged between the stoppers and the resilient members and abutting against the resilient members; and a sliding member coupled between the housing and the base and slidable in sequence along the first, second and third sections of the groove of the base; wherein said insert plates are retained in through holes in said side walls; wherein the mating portions of the terminals each have a needle configuration; wherein the housing defines a receiving slot in a bottom surface thereof and a positioning post extending downwardly from the housing and protruding into the receiving slot; wherein the sliding member defines a hole at an end through a top surface and a bottom surface thereof, the positioning post fitting into the hole, a protruding tip being formed on the bottom surface of an end of the sliding member opposite the hole; wherein the housing forms a guiding block at each of two sides thereof for mating with the guiding portion of a corresponding guiding device; wherein the tip extends into the groove.

2. The electrical connector as claimed in claim 1, wherein the guiding portion is a guiding slot, the resilient member is a spring and the stopper is a block.

3. The electrical connector as claimed in claim 2, wherein the guiding device defines a recess at a rear of the guiding slot, and the housing forms a protruding post on the soldering surface, one end of the spring being retained within the recess and the other end thereof being retained to the protruding post.

* * * * *